US006186378B1

(12) United States Patent
Lung

(10) Patent No.: US 6,186,378 B1
(45) **Date of Patent: *Feb. 13, 2001**

(54) PULP-MOLDED DUMMY

(76) Inventor: Lin Chao Lung, No. 65 Hsining South Road, Taipei (TW)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/556,893

(22) Filed: Apr. 20, 2000

(51) Int. Cl.[7] ..... A41H 5/00

(52) U.S. Cl. ..... 223/120; 223/68

(58) Field of Search ..... 223/66, 68, 120; D20/29–32; 434/396

(56) References Cited

U.S. PATENT DOCUMENTS

| | | | | |
|---|---|---|---|---|
| 1,502,457 | * | 7/1924 | Brecker et al. | 223/66 |
| 3,082,920 | * | 3/1963 | Stein et al. | 223/66 |
| 5,409,150 | * | 4/1995 | Tranquilli | 223/68 |
| 5,782,389 | * | 7/1998 | Maharg | 223/66 |

* cited by examiner

*Primary Examiner*—Bibhu Mohanty
(74) *Attorney, Agent, or Firm*—W. Wayne Liauh

(57) ABSTRACT

A pulp-molded dummy includes vacuum-molded front and back half shells that are dried and compressed to obtain smooth outer surfaces and desired density and hardness approximate to that of wood. The front and the back half shells are provided on inner surfaces with predetermined number of pairs of upper and lower flanges. Horizontal paper partitions may be connected to interior of said front and said back half shells by separately engaging outer peripheral edges of said paper partitions with said pairs of upper and lower flanges in order to reinforce said pulp-molded dummy.

3 Claims, 4 Drawing Sheets

PULP-MOLDED DUMMY

BACKGROUND OF THE INVENTION

The present invention relates to a pulp-molded dummy, and more particularly to a pulp-molded dummy that is completely recyclable and would not cause any public hazard and therefore meet international environmental protection requirements.

Most of the conventional dummies are made of fiberglass (FRP). The FRP dummy is welcomed for its light weight, smooth surface and sufficient structural strength. However, FRP dummy is prohibited for use in some advanced European and American countries that deem environmental protection of great importance, because fiberglass is a kind of chemical compound and is hazardous to the environment.

There is a paper-made dummy developed in foreign countries to replace the FRP dummies. Such paper dummy is formed by gluing paper onto a mold sheet by sheet and layer by layer until the glued paper reaches a required thickness. Such paper dummy is completely hand-made and therefore requires a lot of time and labor to complete it. Moreover, a large quantity of solvent-based bonding material is used to glue the paper onto the mold and workers' hands are subject to skin illness due to contact with such bonding material for a prolonged time. And, such solvent-based bonding material will cause environmental pollution, too.

It is therefore tried by the inventor to develop a dummy that fully meets the requirement of environmental protection and may be easily formed to eliminate the drawbacks existing in the conventional FRP and paper dummies.

SUMMARY OF THE INVENTION

A primary object of the present invention is to provide a pulp-molded dummy that can be easily formed to obtain smooth outer surface and sufficient hardness, and meets the requirement of environmental protection.

To achieve the above and other objects, the pulp-molded dummy of the present invention mainly includes a front half shell and a back half shell both being formed through vacuum-molding of pulp. The vacuum-molded front and back half shells are dried and compressed to obtain high density and smooth outer surface. Several pairs of upper and lower flanges are provided on inner surface of the front and the back half shells at predetermined positions, such that pulp-molded partitions can be horizontally connected to the front and the back half shells to reinforce the same by engaging outer peripheral edges of the paper partitions with the pairs of upper and lower flanges.

Continuous groove and continuous rib may be separately formed along outer peripheral edges of the front and the back half shells, so that the front and the back half shells may be assembled to each other by engaging the groove with the rib to form a complete hollow dummy.

The pulp-molded hollow dummy is internally provided with a paper pipe vertically extended through the horizontal paper partitions. A supporting pipe upward extended from a stand extends through a metal coupler provided at a bottom of the dummy and into the paper pipe. When the dummy is adjusted to a desired height relative to the supporting pipe, the latter may be locked to the metal coupler by tightening a stop screw against the metal coupler.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
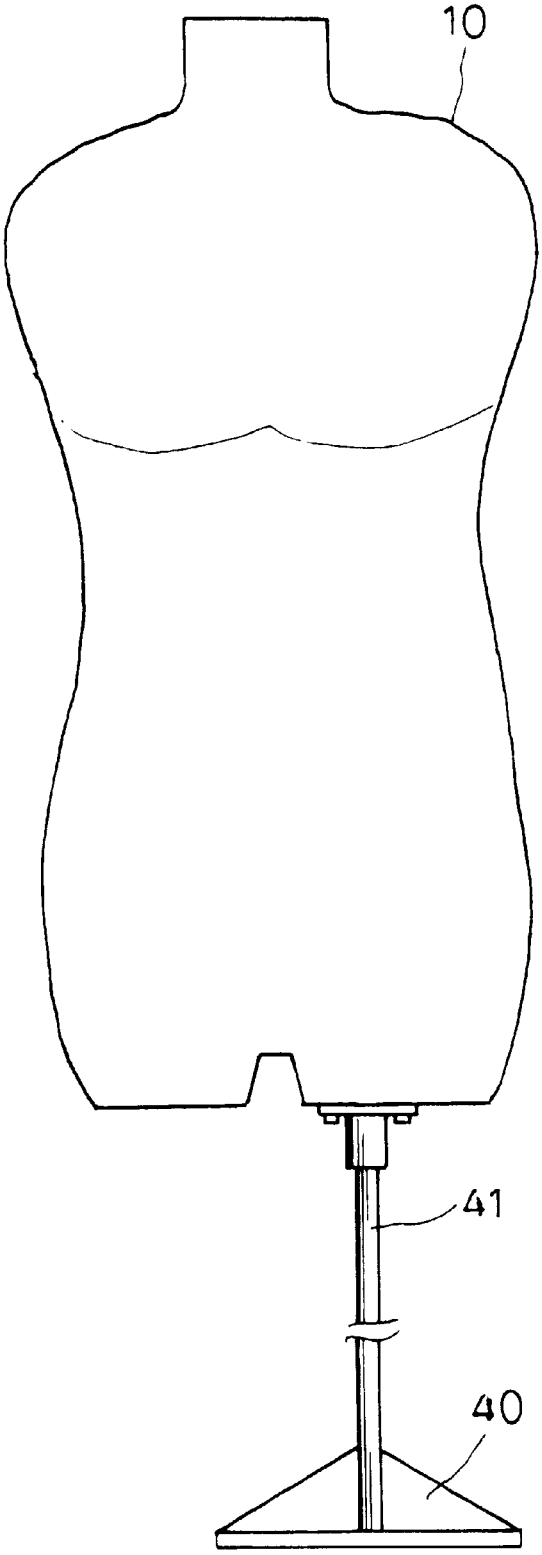
FIG. 1 is a front elevational view of a pulp-molded dummy according to the present invention.
Figure 2:
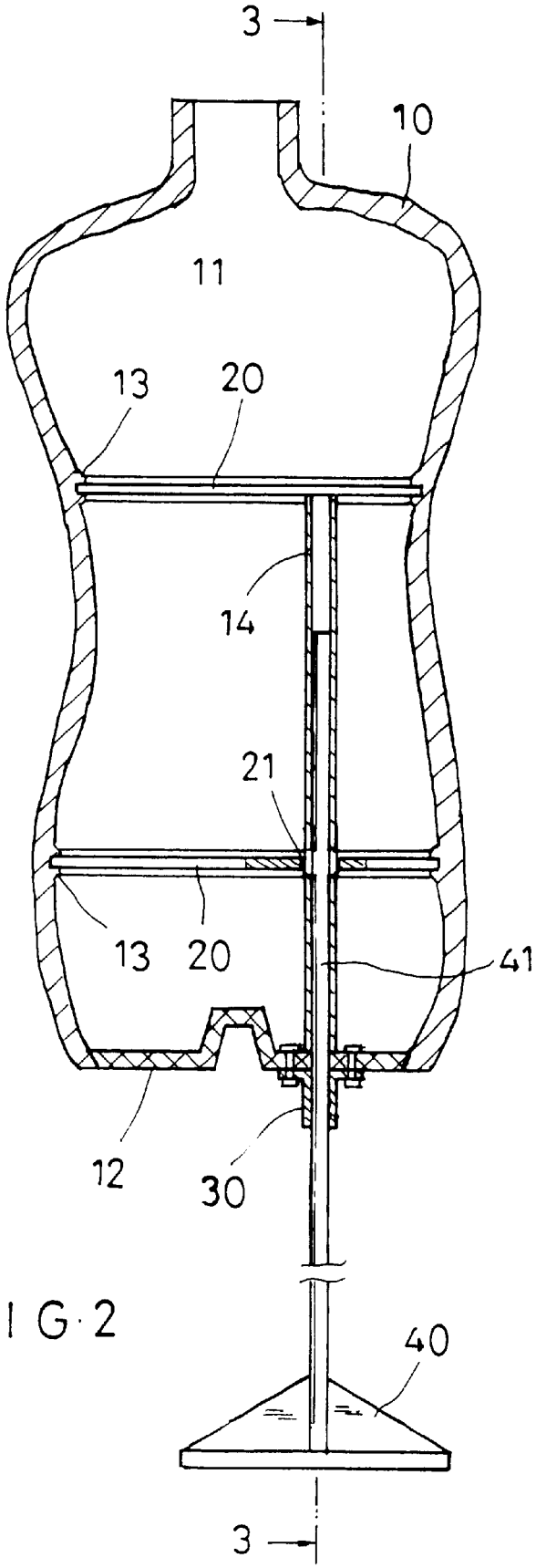
FIG. 2 is a front sectional view of the pulp-molded dummy of FIG. 1.
Figure 3:
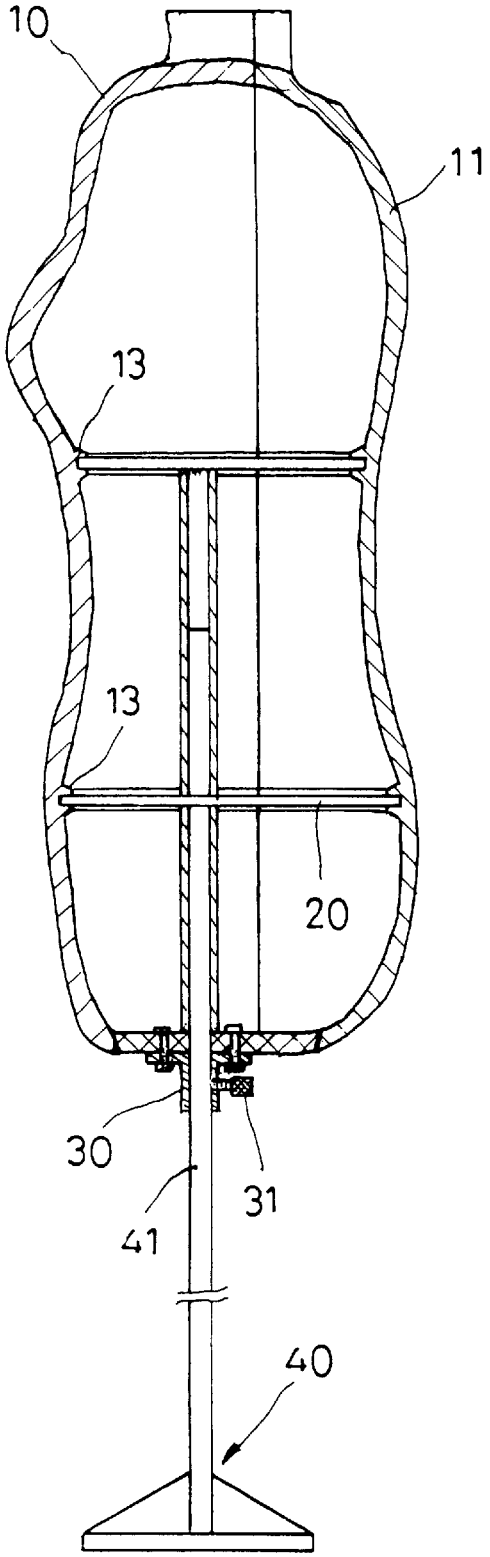
FIG. 3 is a side sectional view taken on line of 3—3 of FIG. 2.

Please refer to FIGS. 1 to 3 in which a pulp-molded dummy according to the present invention is shown. The pulp-molded dummy mainly includes a front half shell 10 and a back half shell 11 both being formed through vacuum-molding of pulp. The vacuum-molded front and back half shells 10 and 11 are dried and compressed with suitable machine to obtain high density and smooth outer surface. Two or three horizontal paper partitions 20 may be fixedly glued to interior of the front and the back half shells 10, 11 to serve as internal reinforcement, so that a dummy formed by connecting the front and the back half shells 10, 11 to each other has an enhanced structural strength. The paper partitions 20 may also be formed by molding and compressing pulp to obtain a desired shape and density. The front and the back half shells 10, 11 are connected to each other by, for example, gluing along their peripheral edges, so that a complete hollow dummy is formed. A bottom of the hollow dummy may be closed with a sealing board 12.

For the paper partitions 20 to fixedly glue to the front and the back half shells 10, 11, one or more pairs of upper and lower flanges 13 are provided on inner surface of the front and the back half shells 10, 11 at predetermined positions, such that outer peripheral edge of each paper partition 20 can be easily received between a pair of upper and lower flanges 13.

A groove may be formed to continuously extend along the inner surface of the front half shell 10 close to the peripheral edge thereof. Similarly, a rib may be formed to continuously extend along the inner surface of the back half shell 11 close to the peripheral edge thereof and corresponding to the groove of the front half shell 10. Whereby when the front and the back half shells 10, 11 are aligned with each other along their peripheral edges, the groove engages with the rib to facility easy formation of a complete hollow dummy.

The horizontal paper partitions 20 in the pulp-molded dummy are provided with a through hole 21 each for a paper pipe 14 to vertically extend therethrough and therefore be fixed in the dummy. The sealing board 12 at the bottom of the dummy is provided with a short metal coupler 30 to align with a lower end of the paper pipe 14 in the dummy, so that a supporting pipe 41 having a lower end connected to a stand 40 may have its upper end upward extended through the short metal coupler 30 into the paper pipe 14. The supporting pipe 41 is slidable in the paper pipe 14 to enable adjustment of a vertical position of the dummy relative to the stand 40. When a desired relative height of the dummy is decided, the supporting pipe 41 may be fixedly locked to the short metal coupler 30 by tightening an adjustable stop screw 31 provided on the metal coupler 30 against the supporting pipe 41.

The front and the back half shells 10, 11 have a thickness about 0.8 mm before they are dried. However, they are then dried and compressed to be 0.4 mm in thickness that gives the two half shells 10, 11 density and hardness almost approximate to that of wood. Meanwhile, the pairs of upper and lower flanges 13 are formed at the time of compressing the two half shells 10, 11 for holding the horizontal paper partitions 20 in place.

Figure 4:
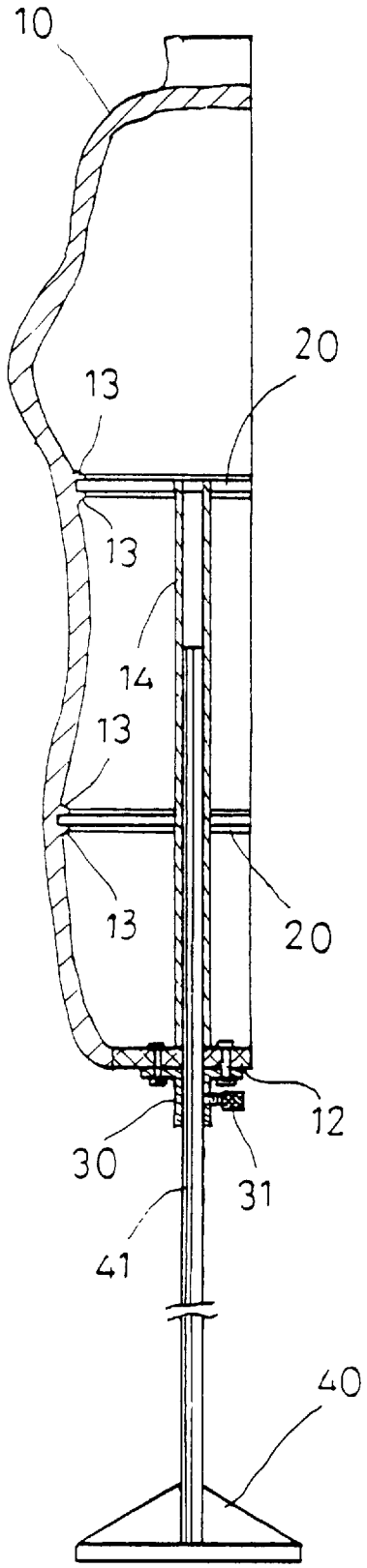
FIG. 4 is a side sectional view of a simple pulp-molded dummy according to the present invention that includes only a front half shell.

It is possible to provide a simple pulp-molded dummy that includes only the front half shell 10, as shown in FIG. 4. In this case, the horizontal paper partitions 20 are so designed that their contours would not go beyond a rear peripheral edge of the front half shell 10.

Moreover, since the pulp-molded dummy of the present invention is completely recyclable and accordingly environment-friendly, it meets the requirements of environmental protection of all advanced countries.

What is claimed is:

1. A pulp-molded dummy comprising a front half shell and a back half shell both being vacuum-molded pulp; said vacuum-molded front and back half shells being dried and compressed to obtain high density and a smooth outer surface, a predetermined number of horizontal paper partitions being fixedly connected to the interiors of said front and said back half shells to serve as internal reinforcement of said pulp-molded dummy, said front and said back half shells being connected to each other along their peripheral edges to form a complete hollow dummy, and a bottom of said hollow dummy being closed with a sealing board.

2. A pulp-molded dummy as claimed in claim 1, wherein said front and said back half shells are provided on the inner surfaces at predetermined positions with a predetermined number of pairs of upper and lower flanges, such that outer peripheral edges of said paper partitions can be easily received between said pairs of upper and lower flanges before being fixedly connected to said front and said back half shells.

3. A pulp-molded dummy as claimed in claim 1, wherein said paper partitions are formed through molding and compressing pulp to obtain desired shape and density.

* * * * *